US012698703B2

(12) United States Patent
Friedrich et al.

(10) Patent No.: US 12,698,703 B2
(45) Date of Patent: Aug. 4, 2026

(54) THREE-DIMENSIONAL DRILLING COLLISION AVOIDANCE DISPLAY

(71) Applicant: Halliburton Energy Services, Inc., Houston, TX (US)

(72) Inventors: Robert Alan Friedrich, Houston, TX (US); Cili Sun, Houston, TX (US); Min Wu, Houston, TX (US); Deepak Subiramaniyam, Houston, TX (US); Bipin K. Pillai, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 46 days.

(21) Appl. No.: 18/140,332

(22) Filed: Apr. 27, 2023

(65) Prior Publication Data

US 2024/0026773 A1 Jan. 25, 2024

Related U.S. Application Data

(60) Provisional application No. 63/390,871, filed on Jul. 20, 2022.

(51) Int. Cl.
*E21B 47/022* (2012.01)
*E21B 7/04* (2006.01)

(52) U.S. Cl.
CPC ..... *E21B 47/022* (2013.01); *E21B 7/04* (2013.01); *E21B 2200/20* (2020.05)

(58) Field of Classification Search
CPC ..... E21B 47/022
See application file for complete search history.

(56) References Cited

U.S. PATENT DOCUMENTS 5,901,795 A 5/1999 Tsao et al.
2009/0152005 A1* 6/2009 Chapman ..... E21B 44/00 702/9
2010/0271232 A1* 10/2010 Clark ..... E21B 47/0228 340/853.2

(Continued)

OTHER PUBLICATIONS

Examination Report; Great Britain Application No. 2308600.2; mailed Nov. 27, 2023.

(Continued)

*Primary Examiner* — Giovanna Wright
(74) *Attorney, Agent, or Firm* — NOVAK DRUCE CARROLL LLP

(57) ABSTRACT

Aspects of the disclosed technology provide solutions for facilitating user visualization and control the path of a new wellbore in three-dimensions (3D). This may include displaying visualizations that show a current well path, a well plan, all nearby offset well paths, and well path projections in a manner that may use different projection methods. These visualizations may also include boundaries where a drilling tool should not go, such "No-Go-Zones" may be shown in a 3D spatial visualization. Visualizations may be displayed continuously along the well path, at survey stations, and at user-defined depth positions during a drilling process. Such visualizations may include projections that show an anticipated wellbore path, based on current settings of a drilling control system. Alerts may be triggered to warn users of various issues that may affect a new well being drilled. Systems, methods, and computer-readable media are provided.

20 Claims, 7 Drawing Sheets

(56) References Cited

U.S. PATENT DOCUMENTS

| | | | | |
|---|---|---|---|---|
| 2011/0153300 | A1* | 6/2011 | Holl | E21B 41/00 703/10 |
| 2013/0140037 | A1* | 6/2013 | Sequeira, Jr. | E21B 7/04 703/10 |
| 2016/0090822 | A1 | 3/2016 | Lu | |
| 2016/0102544 | A1 | 4/2016 | Aklestad et al. | |
| 2018/0051552 | A1* | 2/2018 | Li | E21B 47/024 |
| 2019/0106982 | A1* | 4/2019 | Willerth | E21B 7/04 |
| 2019/0257189 | A1 | 8/2019 | Bang | |
| 2019/0376379 | A1 | 12/2019 | Ramjit et al. | |
| 2020/0248545 | A1* | 8/2020 | Maus | E21B 44/00 |
| 2022/0195804 | A1 | 6/2022 | Codling et al. | |

OTHER PUBLICATIONS

International Search Report & Written Opinion; PCT Application No. PCT/US2023/020383; mailed Aug. 16, 2023.

* cited by examiner

THREE-DIMENSIONAL DRILLING COLLISION AVOIDANCE DISPLAY

CROSS-REFERENCE TO RELATED APPLICATIONS

This application claims priority to U.S. Provisional Patent Application 63/390,871, filed on Jul. 20, 2022, and entitled "THREE-DIMENSIONAL DRILLING COLLISION AVOIDANCE DISPLAY," the contents of which are hereby incorporated by reference in their entirety and for all purposes.

TECHNICAL FIELD

The present disclosure generally relates to controlling drilling operations and in particular, the present disclosure is directed to providing image data to a user when a wellbore is drilled.

BACKGROUND

Areas where oil and gas wells are located may include several different holes that have been or that are in the process of being drilled. Such holes are commonly referred to as wells, boreholes, or wellbores. Modern drilling equipment is not limited to drilling boreholes in straight lines. Typically, modern drilling equipment can be guided to change directions such that individual wellbores may turn at different angles along a path. Because of this, in areas where numerous wellbores are located there is a risk that a drilling operation could result in one wellbore intersecting or "colliding" with another wellbore. Such intersections or collisions can be very expensive to fix and can result in safety issues occurring at a well site.

BRIEF DESCRIPTION OF THE DRAWINGS

In order to describe the manner in which the features and advantages of this disclosure can be obtained, a more particular description is provided with reference to specific embodiments thereof which are illustrated in the appended drawings.

DETAILED DESCRIPTION

Figure 1A:
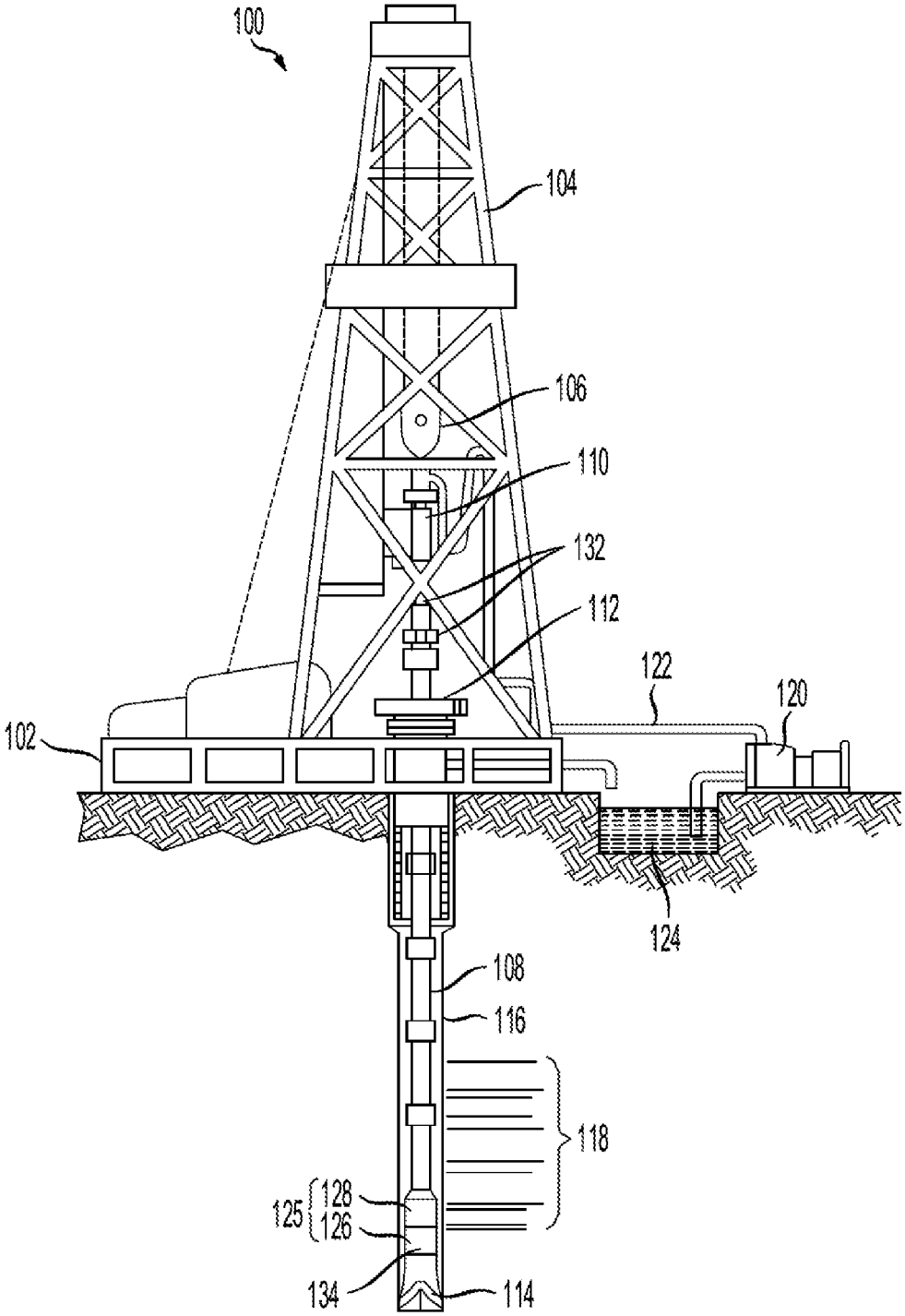
FIG. 1A is a schematic diagram of an example logging while drilling wellbore operating environment, in accordance with various aspects of the subject technology.

Various examples of the disclosure are discussed in detail below. While specific implementations are discussed, it is understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The present disclosure is directed to methods and apparatus that control oil or gas well drilling operations in ways that prevent the path of a new well hole/wellbore from intersecting/colliding with the path of another wellhole. Having a collision while drilling provides drilling companies with huge safety concerns and such collisions may be very expensive to repair. Being able to visualize in a three-dimensional (3D) space a current drilling path and other existing wells (i.e., offset) wells that are nearby, drastically reduces the chance of collision. Methods of the present disclosure enable users to visualize locations where a drill should not go (No-Go-Zones). Visualizations may include projections that traverse along an entire path that the well is intended to traverse (potential well path). These visualizations may be provided to users using a 3D representation view. Such a view may depict points of importance (i.e., survey stations) along the drill path. Such survey station points may be locations that are intended to be included in a wellbore path. Users may be able to view multiple projections of wellbore paths when comparing multiple different collision scenarios. Visualizations of these wellbore paths may be referred to as a travel cylinder (TC) plot that identifies areas where a drilling apparatus may drill (Go-Zones) and that identifies areas where a drill should not go. As such, TC plots may show Go-Zones and No-Go-Zones.

A user may then be allowed to pick an approach or path forward using various tools or methods. Such projections may include computer imaging software (custom and/or proprietary) used to generate and or display views of previously drilled wellbores or areas where wellbores can be drilled. Such software may allow users to view compatible views, straight-line views, current curvature projections, or customized projections of wellbores of a field of wellbores based on user or programmed input, for example. Software used to generate images of wellbores may be part of a system that allows users to control drilling equipment in real time. An example of such a system is a LOGIX autonomous drilling platform that allows users to steer a drilling apparatus.

In certain instances, a drilling operation may be automated and paths that the drilling apparatus drills may be identified by a processor that executes instructions of a computer model. A set of equipment that controls the drilling apparatus may receive data from the processor that executes the instructions of the computer model when a wellbore is drilled. This received data may identify a pathway that the drilling apparatus drills. Alternatively, or additionally, user input may be received that includes data that identifies the pathway that the drilling apparatus drills.

Apparatus consistent with the present disclosure may allow users to visualize and control the path of a new wellbore in three-dimensions (3D). This may include display visualizations that show a current well path, a well plan, all nearby offset well paths, and well path projections in a manner that may use different projection methods. These visualizations may also include boundaries where a drilling tool should not go, such "No-Go-Zones" and these visualizations may be shown in a 3D spatial rendering.

Users may view 3D visualizations when wearing a heads-up display device like the Microsoft HoloLens. Visualizations provided to users may be a 3D representation that is displayed on a two-dimensional (2D) display or may be a 2D display showing cross-sections of wellbores. As such, any type of display device may be used when visualizations in either two or three dimensions are provided to users. Visualizations may be displayed continuously along the well path, at survey stations, and at user-defined depth positions during a drilling process, for example. Such visualizations may include projections that show an anticipated path where a hole will pass given current settings of wellbore drilling control system. Alerts may be triggered to warn users of various issues that may affect a new well being drilled. For example, an alert may be generated when a projection of a new wellbore path is approaching a zone that is designated as a "No-Go-Zone." Such alerts may result in notifications being sent or provided to users, a specified user group, or a computing system. In certain instances, an application program may be used to monitor drilling operations and this application program may be configured to implement actions that conform to safety rules when an alert is generated.

Turning now to FIG. 1A, a drilling arrangement is shown that exemplifies a Logging While Drilling (commonly abbreviated as LWD) configuration in a wellbore drilling scenario 100. Logging-While-Drilling typically incorporates sensors that acquire formation data. Specifically, the drilling arrangement shown in FIG. 1A can be used to gather formation data through an electromagnetic imager tool as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, acoustic telemetry, and/or the like). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
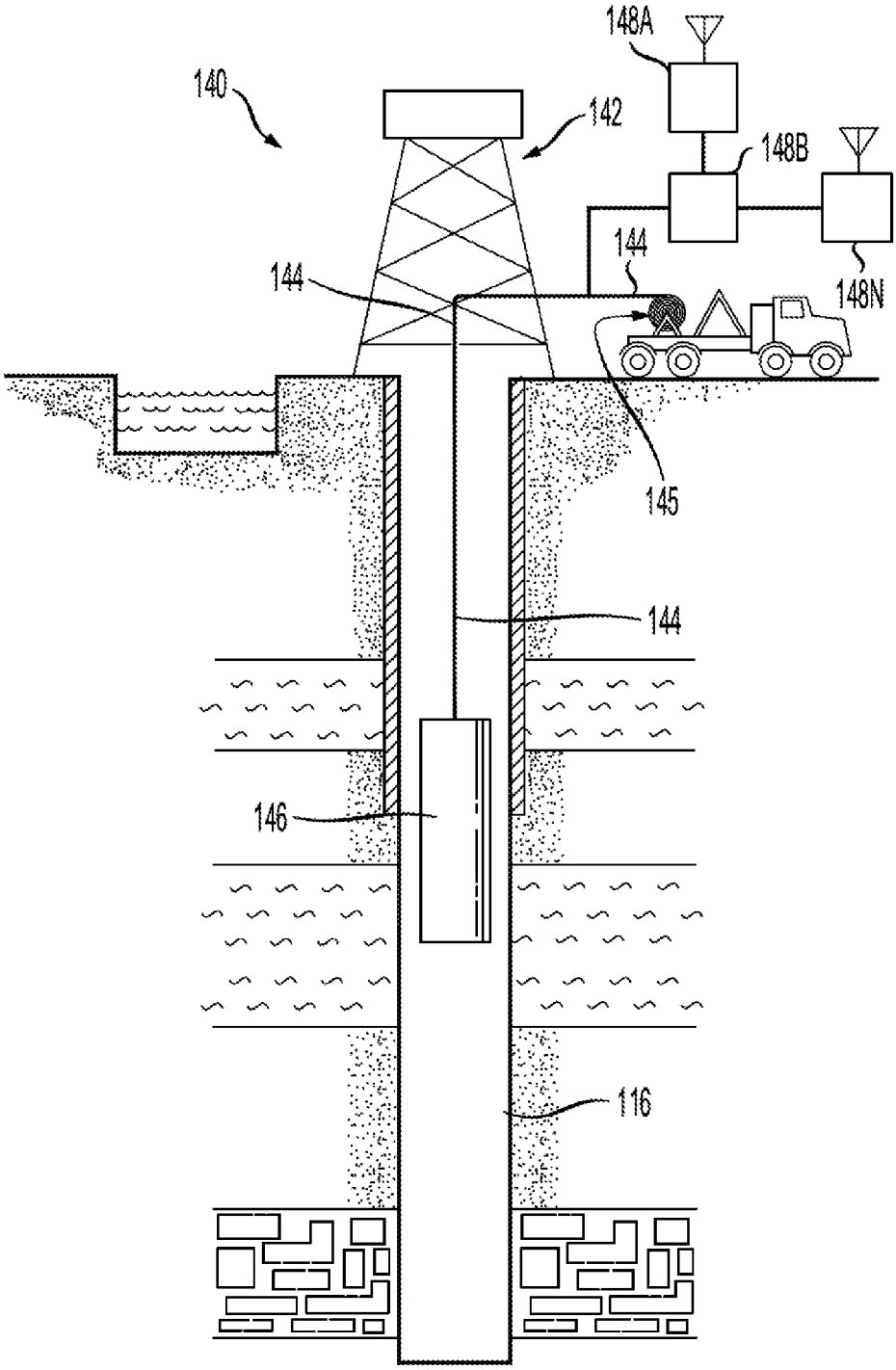
FIG. 1B is a schematic diagram of an example downhole environment having tubulars, in accordance with various aspects of the subject technology.

Referring to FIG. 1B, an example system 140 is depicted for conducting downhole measurements after at least a portion of a wellbore has been drilled and the drill string removed from the well. An electromagnetic imager tool can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Methods of the present disclosure allow for paths of new wells to be established, monitored, and controlled with an aim of avoiding crossing an area that has been designated as an area that should not be drilled—a "No-Go-Zone" where the path of the new well should not go. Such, "No-Go-Zones" may be avoided by using 3D data. This may include using a 3D tube or a 3D projection plot (3D travel cylinder—TC Plot) of the path of the new wellbore. Visualizations may be used to allow a user to easily identify and evaluate multiple trajectories that could be included in the wellbore path. Such methods allow a user to visualize a current position of drilling machinery and a projection of a wellbore path such that the user can steer the drilling machinery in 3D space.

As mentioned above visualizations may also include boundaries where "No-Go-Zones" may be shown in two-dimensional (2D) or 3D space. These visualizations may be displayed continuously along the well path, at survey stations, and at user-defined depth position during a drilling process. Such visualizations may include projections that show an anticipated path where a hole will pass given current settings of a wellbore drilling control system. Alerts may be triggered to warn users of various issues that may affect a new well being drilled. For example, an alert may be generated when a projection of a new wellbore path is approaching a "No-Go-Zone." Such alerts may result in notifications being sent or provided to users, a specified user group, or a computing system. In certain instances, an application program may be used to monitor drilling operations and this application program may be configured to implement particular actions when an alert is generated.

A user may be provided with an interface that include display options that allow the user to change how information is displayed on their display. These options may allow a user to:

- Display or hide a full 3D grid of a wellbore path and surrounding area;
- Display different types of projections to allow the user to identify a best path forward using various types of functions in a desired format (e.g., a LOGIX compatible, a straight-line, a current curvature, or a customized format);
- Display and show survey stations with tool tips for entire well path;
- Display Historical 3D plots that can be viewed as a full travel cylinder (TC) Plot or just No-Go-Zones/Alert Zones;
- Display 3D real-time (RT) TC Plot that can be viewed as a full TC Plot or just No-Go-Zones/Alert Zones;
- Display a 3D Project Ahead TC Plot that can be viewed as a full TC Plot or just No-Go-Zones/Alert Zones, the project ahead depth is based on the projection being used so likely different depths;
- Select a quick view button to toggle between different display selections: toggle between an RT TC plot and a Project Ahead TC plot, or to change from a 3D view to a two-dimensional (2D) View;
- Display offset wells within No-Go-Zone boundaries even when an option of "offset wells" is disabled;
- Display a directional box to visually show a user a direction they are viewing;
- Display a measuring tool that can be used to measure distances between an offset well (or well plan) and an active well path;
- Set up user preference alerts and notification methods. For example, a user may be allowed to select that notifications should be provided via a pop-up on screen or an email. Such notifications may include a link that allows users to access drilling job data (e.g., LOGIX job data). Selecting the link may result in a webpage being displayed on a user display such that the user may view, for example, a LOGIX webpage.

Figure 2:
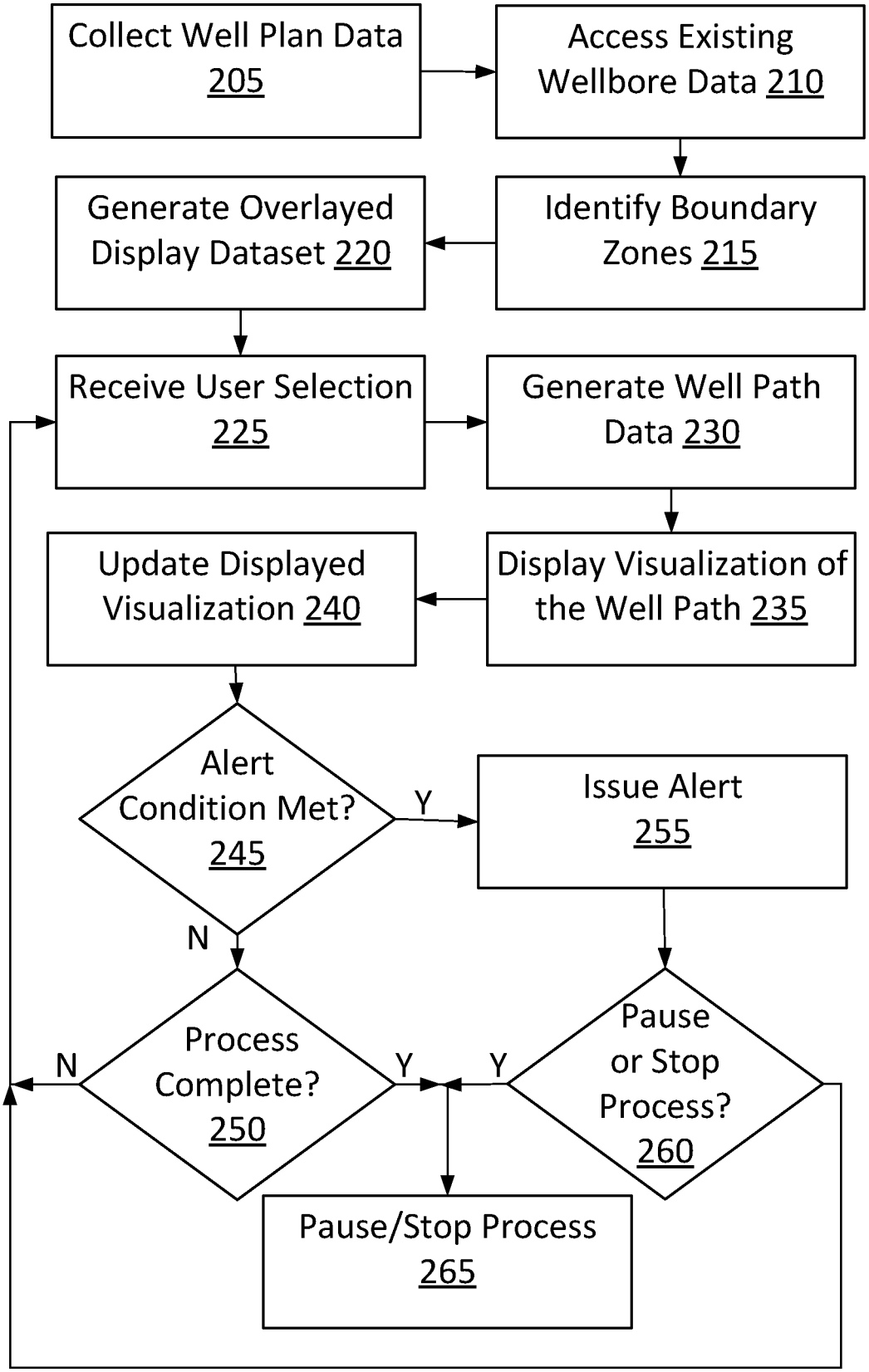
FIG. 2 illustrates a series of steps that may be performed by a method that provides users with visualizations associated with the drilling of a wellbore, in accordance with various aspects of the subject technology.

FIG. 2 illustrates a series of steps that may be performed by a method that provides users with visualizations associated with the drilling of a wellbore. FIG. 2 begins with step 205 where well plan data is collected or accessed. This well plan data may identify a starting point of a drilling operation, one or more points of interest or importance that should be included in a well path, and an endpoint of the well plan. The starting point, points of interest/importance, and/or the endpoint may be classified as survey stations along the path of a proposed well path. The well path may be a projected or tentative path, it may be an actual path that has already been drilled, or the well path may be a combination of a projected/tentative path and an actual path.

After step 205, existing wellbore data may be accessed in step 210. This existing wellbore data may include visualization data or visualizations of paths of existing wellbores may be generated from this existing wellbore data. Boundary zones may then be identified in step 215. Boundary zones may be identified based on rules that a computer may use to identify where "No-Go-Zones" should be included in a visualization. Such rules may identify minimum safe distances around existing boreholes. Next in step 220, an overlayed display dataset may be generated. This overlayed data set may show locations of existing boreholes, No-Go-Zones, and possibly a projected pathway that is consistent with the well plan data.

A user selection or input may then be received in step 225 and a well path data may be generated in step 230. The user selection received in step 225 may identify a type of display or this selection may select any of the user options mentioned above. User selections/inputs may also identify a pathway that the user wishes to evaluate. After step 230, a visualization of the projected well path may be displayed or updated according to the user selections. A user may make various selections and view various potential pathways that could be followed by a drilling machine. As the drilling machine drills the wellbore, the visualization displayed in step 235 may be updated in step 240. As mentioned above visualizations associated with a new well may show a well path, a well plan, all nearby offset well paths, and/or well path projections using different projection methods. These visualizations may also show boundaries of No-Go-Zones and each visualization may be shown in 3D space continuously as the well is drilled.

Determination step 245 may identify whether an alert condition has been met. Such an alert condition may identify that the projected wellbore path meets an alert condition. Such an alert condition may identify that the drilling machine will likely cross a boundary of a boundary zone or enter within a threshold distance of another wellbore. When an alert condition is met, program flow may move to step 255 where an alert is issued. Such an alert could include sending a message to users, engaging a visual or audio alert indication, or sending an email to a user group. The alert condition may also result in movement of a drill being paused automatically until the alert condition is resolved or overridden.

After the alert is issued, determination step 260 may identify whether the drilling process should be paused or stopped, when yes program flow may move to step 265 where the drilling operation is paused or stopped. Decisions regarding whether to pause or stop a drilling process may be automatic, may be based on user discretion, or both. Whether an action is taken automatically or based on user input may be a function of a set of rules that govern the drilling process and these rules may be associated with a danger or threat level. For example, in an instance when a drill bit is projected to enter within a threshold distance from a nearby wellbore, yet projections indicate that continued drilling along a current path will not collide with the nearby wellbore, a first level alert may be issued. This first level alert may allow the drill to continue drilling unless a correction is provided by a user or until some other event occurs. In an instance when a projection indicates that continued drilling will likely (above a threshold level) collide with the nearby wellbore or be closer than a safety margin, the drilling operation may be stopped automatically. In certain instances, after a drilling process has been stopped, the drilling process may be restarted by a user. When determination step 260 identifies that the drilling process should not be stopped, program flow may move back to step 225 where additional user input may be received. While the visualizations discussed in respect to FIG. 2 are generated based on user selections or user inputs, such visualizations may be generated based on actions performed by a processor that executes instructions of a computer model that identifies potential drilling pathways or that controls paths along which a drilling assembly drills. In certain instances, a user may view different pathways identified by the computer model and select a path of the different pathways where the drilling assembly should be drilled. As such, operations of a drilling assembly may be controlled by a user, may be controlled by a computer, or may be controlled by receiving a combination of user and machine generated drilling data.

When determination step 245 identifies that the alert condition has not been met, program flow may move to determination step 250 that identifies whether the drilling process is complete, when yes, program flow may move from step 250 to step 265 where the drilling process is stopped. When determination step 250 identifies that the process is not complete, program flow may move back to step 225 where additional user input may be received.

Figure 3:
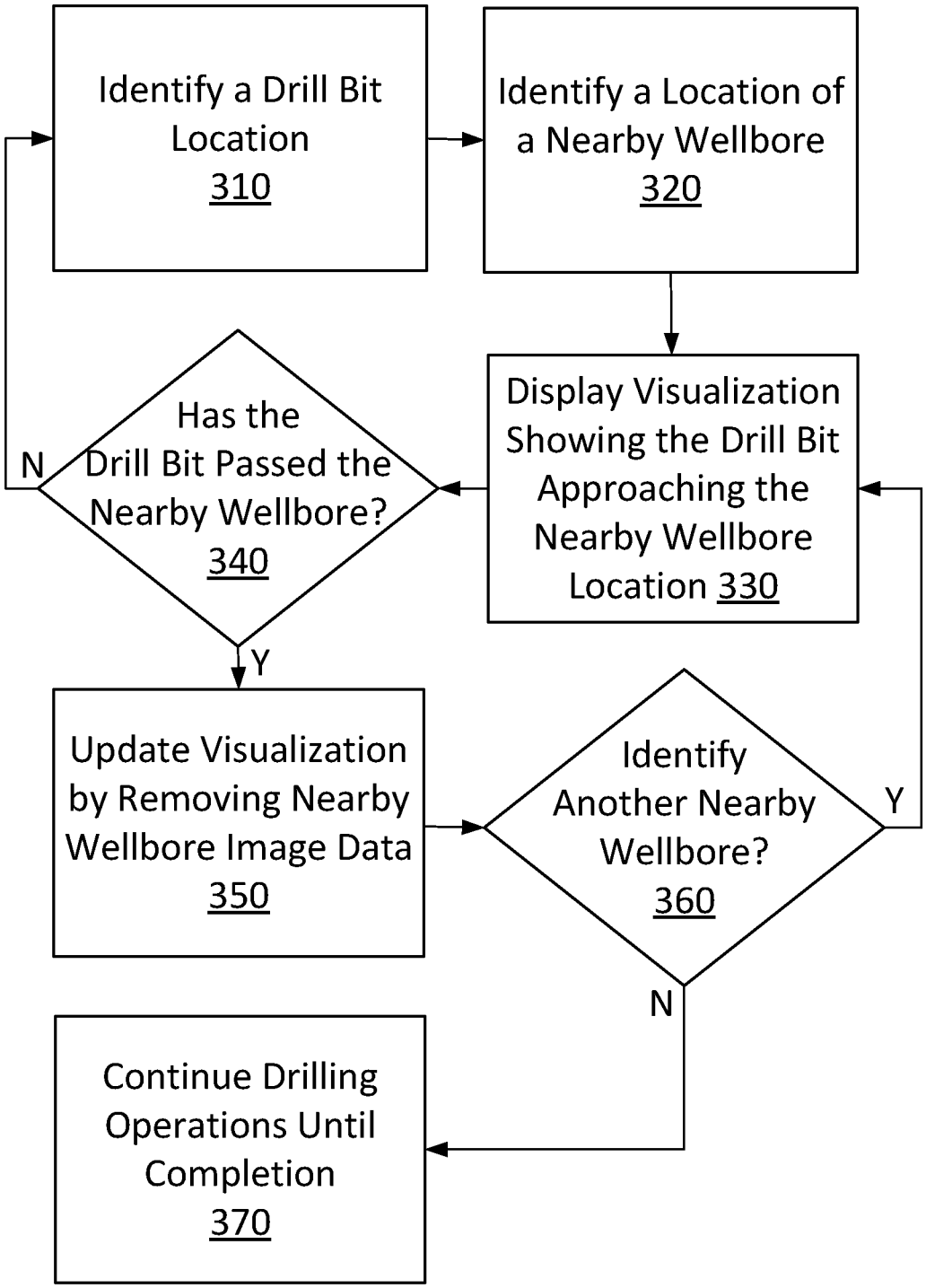
FIG. 3 illustrates actions that may be performed when a wellbore is drilled, in accordance with various aspects of the subject technology.

FIG. 3 illustrates actions that may be performed when a wellbore is drilled. When the wellbore is drilled, progression of the drilling operation may be monitored continuously. Data associated with a direction that a drill bit is drilling may be collected over time. This may include collecting data that identifies an angle at which the drill bit is moving, and data may be collected that identifies distances that the drill bit proceeds along a path into the Earth. Each time an angular position of the drill bit is changed, distances that the drill bit drills may be monitored and recorded. The process of tracking the motion of the drill bit may include collecting sensor data. For example, one set of sensors may measure a movement distance. Angles that a drill bit moves along a path may be monitored to identify whether a drilling assembly is actually moving along a desired path. Inputs used to steer the drill bit and/or sensor data that senses actual changes in direction of the drill bit may be monitored when an actual direction of a drilling operation is interpolated. One reason that both steering inputs and sensor data may be used to identify angles at which the drill bit is drilling is because a steering input may not immediately affect a change in the direction of the drill bit. Another reason that a drill bit may deviate from a planned direction is when changes in hardness of formations in the Earth force the drill bit to move in a direction that is not precisely (within tolerance levels) along the path indicated by steering inputs.

As the drill bit moves, a location of the drill bit in the Earth may be identified at block 310 of FIG. 3. At this time mapping data that identifies locations of wellbores in the vicinity of the wellbore currently being drilled may be accessed. Sets of data associated with the paths of older wellbores may have been collected when these older wellbores were drilled and these sets of collected data may have been stored at a database such that mappings of respective wellbores may be generated. In certain instances, accuracies of such maps may be verified by additional methods (e.g., any sort of ground survey equipment). Once sets of mapping data are available and when a new wellbore is drilled, the sets of mapping data may be used to generate visualizations that show the paths of these older wellbores and a current or new wellbore. Data associated with the drilling of the new wellbore may be overlaid onto/into the visualizations of the older mappings. This data may allow an apparatus of the present disclosure to identify a location of a wellbore that is near the wellbore that is currently being drilled at block 320 as the new wellbore is drilled.

At block 330 a visualization may show that the wellbore being drilled is approaching a location where the nearby wellbore is located. As the drill bit drilling the new wellbore approaches another wellbore, data identifying relative positions of the two wellbores may be extremely important for either an automated drilling monitoring or for users monitoring or controlling the drilling operation. A visualization that shows both wellbores that is viewed by a user allows the user to avoid maneuvering the drill bit into a No-Go-Zone of a nearby wellbore. Once the drill bit has passed a point that is closest to the No-Go-Zone of the nearby wellbore, data associated with the nearby wellbore may no longer be relevant to the current drilling operation. This is because, once the drill bit has moved past a possible point of collision and is moving away from the nearby wellbore, the possibility of a collision no longer exists. A determination may be made at block 340 that identifies whether the drill bit drilling the current wellbore has passed by the nearby wellbore. Such a determination may be made by one or more processors that execute instructions used to evaluate wellbore mapping data and that generates wellbore visualizations. In an instance when determination block 340 identifies that the drill bit has not passed the nearby wellbore, program flow may move to block 310 where the location of the drill bit is updated. When determination step 340 identifies that the drill bit has passed or is no longer approaching the nearby wellbore, program flow may move to block 350 where the visualization is updated. This may include the one or more processors executing instructions that result in images (or portions of images) of the nearby wellbore being removed from the visualization such that the updated visualization does not show the nearby wellbore (or nearby wellbore portion) anymore. By removing such unnecessary visual data, a user may be more able to see and react to other possible upcoming collisions with other wellbores or wellbore No-Go-Zones. Of course, in an instance when a previously avoided wellbore is once again approached, the process may repeat such that the previously avoided wellbore can be avoided again.

After the visualization is updated at block 350, determination block 360 may identify whether there are other nearby wellbores, when no, drilling may continue until drilling operations are completed at block 370. When determination block 360 identifies that there are one or more other nearby wellbores, program flow may move to block 330 where visualization data is displayed that shows the drill bit approaching these other nearby wellbores. By removing unnecessary data, the view of a user may not include information that would block the user from being able to see data associated with other nearby wellbores or No-Go-Zones of a drilling operation.

Figure 4:
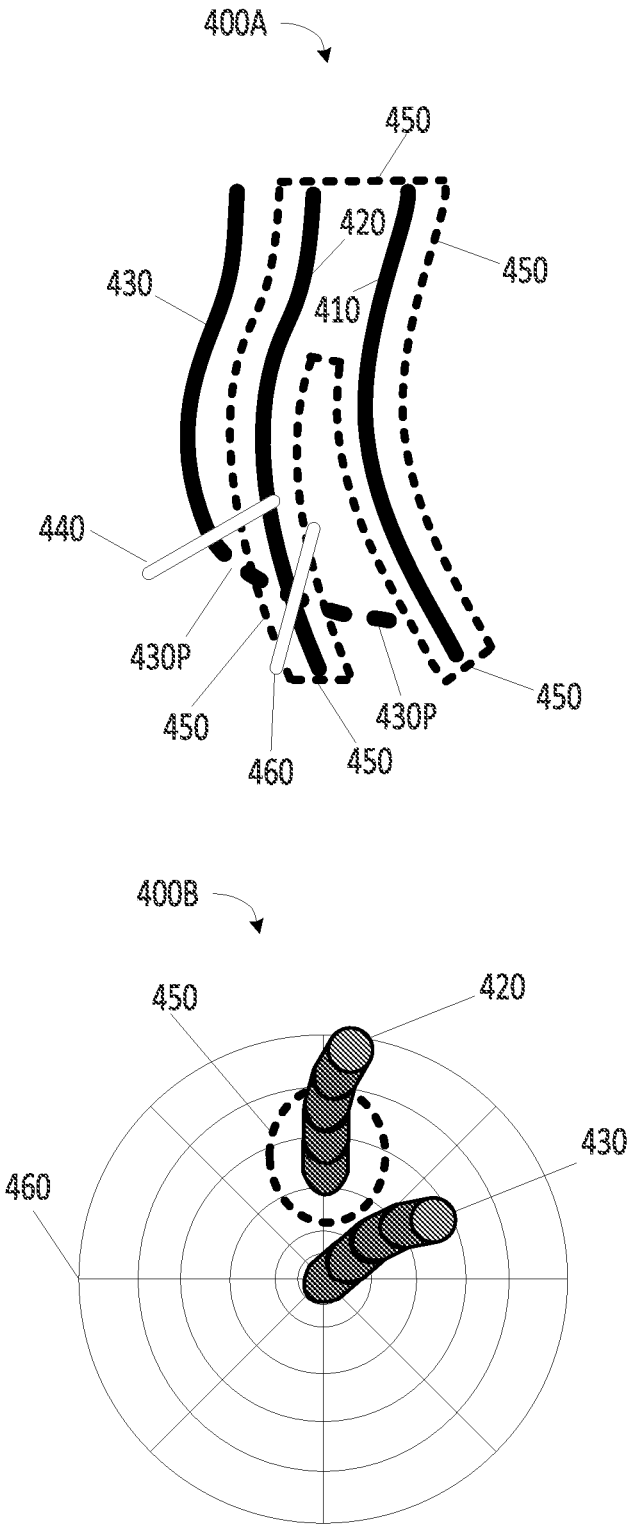
FIG. 4 illustrates two different images that may be presented in one or more visualizations to users monitoring or controlling wellbore drilling as discussed in respect to FIGS. 2-3, in accordance with various aspects of the subject technology.

FIG. 4 illustrates two different images that may be presented in one or more visualizations to users monitoring or controlling wellbore drilling as discussed in respect to FIGS. 2-3. A first image 400A includes three different wellbores 410, 420, and 430 that appear as solid squiggly lines. FIG. 4 also includes dashed line 430P that represents a projection of where wellbore 430 may pass based on control inputs. Dashed line 450 illustrates boundaries of No-Go-Zones near wellbores 410 and 420. Note that dashed line 430P is wider/fatter than dashed line 450 as to make the No-Go-Zone line 450 easily distinguishable from dashed line 430P that represents the projection of where wellbore 430 is currently configured to pass. Inputs that control the direction of a wellbore may be controlled by a user that views wellbore visualization data as the wellbore is drilled and the user may view a path before allowing that path to be drilled. Image 400A of FIG. 4 also includes cross-sectional areas 440 and 460 that may be associated with potential points of collision between a new wellbore and an existing wellbore. Each of the elements of image 400A may be viewed in a visualization of a wellbore field or portion thereof. No-Go-Zones, such as the No-Go-Zone illustrated by dashed line 450 may have complex shapes, these shapes may be identified based on one or more rules associated with maintaining the integrity of existing wellbores. Wellbore integrity rules may be simple or complex, an example of a simple rule is that is that a No-Go-Zone should at least radially surround a perpendicular cross-section of the wellbore along the length of the wellbore. Locations where a group of existing wellbores are close enough such that radial cross-sections surrounding those wellbores overlap, may result in a merged No-Go-Zone that is not be shaped like a single cylinder surrounding the group of wellbores. This may be one reason why the No-Go-Zone of image 400A has a wider portion (near the top of image 400A) that leads to two narrower portions (near lower portions of image 400A). In certain instances, from a particular perspective, two close wellbores may appear to have a shape like the figure eight based on that perspective view being at a point where two No-Go-Zones from two different wellbores meet. Rules associated with areas that should be included in a No-Go-Zone may also include other factors, for example, a rule may specify that a No-Go-Zone around a certain portion of an existing wellbore that passes through sand should be larger than No-Go-Zones associated with wellbore portions that are in solid granite.

FIG. 4 also includes image 400B that includes an alternate view of cross-sectional area 460. Image 400B includes a perspective view of wellbore 420 and wellbore 430. Note that image 400B includes a series of concentric circles that appear as a target centered around wellbore 430. Cross-sectional perspective views of a wellbore may be provided to a user such that the user can easily view potential conflict zones or No-Go-Zones and the user may use such visualizations to steer a drilling assembly safely by an existing wellbore. Each of the concentric circles in a visualization may be associated with a scale that shows distance and/or radial position. As such, a user may be able to direct a drill bit drilling wellbore 430 past wellbore 420 according to a set of rules associated with a field of wellbores. Image 400B also shows No-Go-Zone 450 that has somewhat of an oval shape. This is because the view of image 400B may be at an angle that is not exactly perpendicular to wellbore 420. In an instance when an image of an existing wellbore is drawn from a perspective that is perpendicular to an existing wellbore and when wellbore rules indicate that the No-Go-Zone should radially surround the existing wellbore, this No-Go-Zone may appear to have a circular shape.

As soon as wellbore 430 has passed a point where the drill bit drilling wellbore 430 may collide with wellbore 420, image information associated with wellbore 420 may be removed from image 400B of FIG. 4. This may occur just after the point where wellbores 420 and 430 appear to cross in image 400A of FIG. 4. This allows for wellbores to be drilled more safely as image data that is not relevant to a possible collision between wellbores may be removed. By removing content that could allow the user to miss other important details, the safety of drilling operations is enhanced. For example, if the drilling of wellbore 430 were to continue toward wellbore 410 while a visualization still showed parts of wellbore 420 that have already been passed, an operator may be able to see that a projected drill path could enter a No-Go-Zone associated with wellbore 410. The visualizations of the present disclosure also allow for wellbore fields to be developed faster and in ways that could not be done before.

Figure 5:
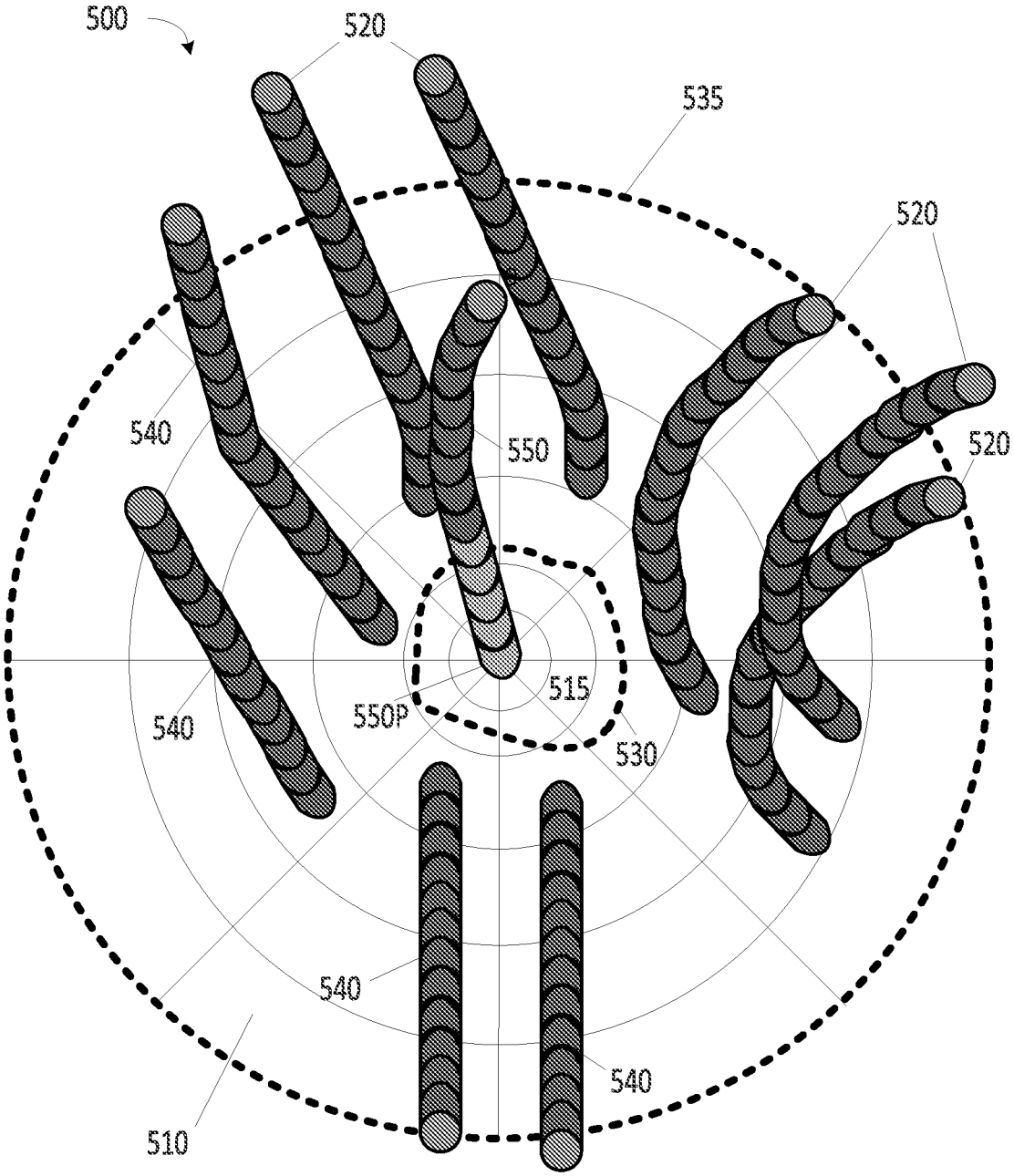
FIG. 5 illustrates a cross-sectional view that includes multiple offset wells, planned wells, and a new wellbore that is being drilled.

FIG. 5 illustrates a cross-sectional view that includes multiple offset wells, planned wells, and a new wellbore that is being drilled. Image 500 of FIG. 5 includes numerous existing wells 520 that may be referred to as offset wells 520 that are near a location where a new wellbore is being planned. Wellbores 540 may be wellbores that are planned to be drilled in the future. Wellbore 550 may be a wellbore that is in the process of being drilled. FIG. 5 illustrates two different sections of wellbore 550, a first darker section 500 that identifies locations where wellbore 550 has already been drilled and a lighter section 550P where wellbore 500 may be drilled based on drilling control inputs.

FIG. 5 also includes dashed lines 530 and 535 that shows No-Go-Zones near wellbore 550. As discussed in respect to FIG. 4, rules that identify locations where No-Go-Zones should be located may be based on various criteria. Such rules may have been applied when the No-Go-Zone lines 530 and 535 were generated. An area 510 between No-Go-Zone line 530 and No-Go-Zone line 535 is an area that may be designated as a No-Go-Zone for wellbore 550. A second area 515 of FIG. 5 surrounds portion 550P of wellbore 550 may be classified a Go-Zone for wellbore 550. Images provided to a user that is controlling or monitoring the drilling of wellbore 550 may include colors or shading that is not shown in FIG. 5. For example, when wellbore 550 is being drilled, No-Go-Zone area 510 of FIG. 5 may be highlighted with a red color and Go-Zone area 515 of FIG. 5 may be shown using a white color. As such, images provided to users may include information that identifies areas where a drill bit should avoid (No-Go-Zones) and that identifies areas where the drill bit can drill into (Go-Zones).

In certain instances, either mechanical constraints of a drilling apparatus or constraints set by drilling rules may be used to identify rules regarding areas that cannot or should not be drilled into. For example, a drilling apparatus may not be able to make turns at angles greater than 45 degrees relative to a current center line of the drilling apparatus when mechanical linkages of the drilling apparatus limit a turn angle of the drilling apparatus or when doing so would possibly increase stresses on the mechanical linkages beyond a threshold level. Another drilling rule could identify minimum and/or maximum approach angles of a drill bit based in areas where densities of rock in an Earth formation change. Such a rule may identify that a drill bit that is currently drilling in softer rock (e.g., sandstone that has a first density) can only be allowed to drill into harder rock (e.g., granite that has a second density) at angles that are less than 15 degrees. A set of drilling rules could, therefore, include different rules that have different constraints, where some constraints may be associated with a part of the drilling assembly and other constraints may be associated with substances included in the Earth. Another drilling rule could identify that cross-sectional areas associated with No-Go-Zones in a first type of rock must be larger than No-Go-Zones in a second type of rock. For example, a cross-sectional area of a No-Go-Zone in granite may be smaller than a cross-sectional area of a No-Go-Zone in sandstone.

Visualizations like those of FIG. 4 and FIG. 5 may be updated to identify an area of a proposed drill path that would violate a drilling rule. Drilling control software may also be configured to not allow a user to command the drilling assembly to drill in a manner that violates a drilling rule. In an instance when a user has difficulty identifying a drilling path that does not violate a drilling rule, the user may be allowed to identify a starting point and/or an ending point of a new wellbore portion. A computer may then be allowed to execute instructions of a geo-steering program when the computer evaluates different potential pathways that could result in the new wellbore being drilled from the starting point to the ending point of the new wellbore portion. The computer could eliminate any potential pathway that violates a drilling rule while identifying one or more viable potential pathways that do not violate any of the drilling rules. The user could then view the viable potential pathways and/or view statistics associated with the viable potential pathways. Such statistics could identify overall lengths, estimated drilling times, and/or margin thresholds for each of the respective viable potential pathways. A margin threshold could identify areas of a viable potential pathway that is within a tolerance range of a drilling rule. For example, when a drilling rule limits a drilling angle to be 45 degrees or less and when a tolerance range of this drilling angle is 5 degrees, angles between 40 degrees and 45 degrees may be highlighted or associated with a higher risk. Data that shows this statistical data may allow a user or automated system to select a drill path based on criteria to save cost, to save time, or to minimize risk.

Figure 6:
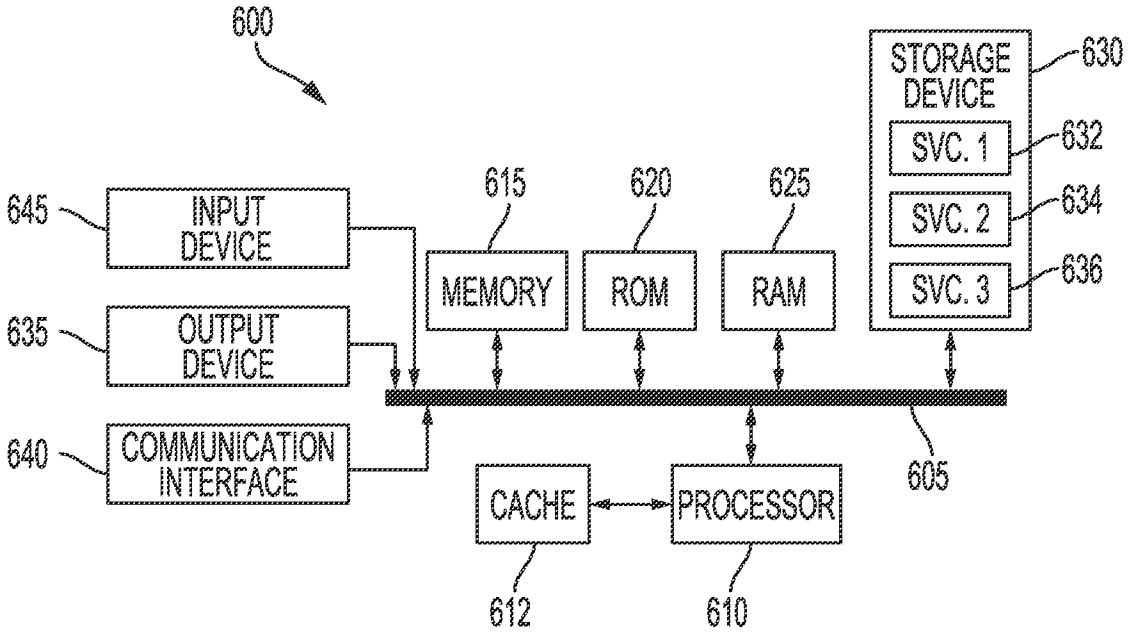
FIG. 6 illustrates an example computing device architecture which can be employed to perform various steps, methods, and techniques disclosed herein.

FIG. 6 illustrates an example computing device architecture 600 which can be employed to perform various steps, methods, and techniques disclosed herein. In some examples, the computing device architecture can be integrated with the electromagnetic imager tools described herein. Further, the computing device can be configured to implement the techniques of controlling borehole image blending through machine learning described herein.

As noted above, FIG. 6 illustrates an example computing device architecture 600 of a computing device which can implement the various technologies and techniques described herein. The components of the computing device architecture 600 are shown in electrical communication with each other using a connection 605, such as a bus. The example computing device architecture 600 includes a processing unit (CPU or processor) 610 and a computing device connection 605 that couples various computing device components including the computing device memory 615, such as read only memory (ROM) 620 and random-access memory (RAM) 625, to the processor 610.

The computing device architecture 500 can include a cache of high-speed memory connected directly with, in close proximity to, or integrated as part of the processor 610. The computing device architecture 600 can copy data from the memory 615 and/or the storage device 630 to the cache 612 for quick access by the processor 610. In this way, the cache can provide a performance boost that avoids processor 510 delays while waiting for data. These and other modules can control or be configured to control the processor 610 to perform various actions. Other computing device memory 615 may be available for use as well. The memory 615 can include multiple different types of memory with different performance characteristics. The processor 610 can include any general-purpose processor and a hardware or software service, such as service 1 632, service 2 634, and service 3 636 stored in storage device 630, configured to control the processor 610 as well as a special-purpose processor where software instructions are incorporated into the processor design. The processor 610 may be a self-contained system, containing multiple cores or processors, a bus, memory controller, cache, etc. A multi-core processor may be symmetric or asymmetric.

To enable user interaction with the computing device architecture 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanisms known to those of skill in the art, such as a display, projector, television, speaker device, etc. In some instances, multimodal computing devices can enable a user to provide multiple types of input to communicate with the computing device architecture 600. The communications interface 640 can generally govern and manage the user input and computing device output. There is no restriction on operating on any particular hardware arrangement and therefore the basic features here may easily be substituted for improved hardware or firmware arrangements as they are developed. While control of computer operations may be performed based on commands received via an input device, commands may be received based on operation of a computer model that generates commands that controls operation of the computer automatically.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof. The storage device 630 can include services 632, 634, 636 for controlling the processor 610. Other hardware or software modules are contemplated. The storage device 630 can be connected to the computing device connection 605. In one aspect, a hardware module that performs a particular function can include the software component stored in a computer-readable medium in connection with the necessary hardware components, such as the processor 610, connection 605, output device 635, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Aspects of the present disclosure include:

Aspect 1: A method comprising: accessing well plan data; accessing existing wellbore data; identifying boundary zone data to associate with an overlaid dataset that includes the well plan data, the existing wellbore data, and the boundary zone data; receiving data that identifies a first potential pathway of a wellbore; and generating a visualization from the overlaid dataset based on receiving the data that identifies the first potential pathway, wherein the visualization is displayed on a display such that a user can view the first potential pathway of the wellbore.

Aspect 2: The method of Aspect 1, further comprising identifying that information associated with the first potential pathway of the wellbore violates a drilling rule associated with a zone where a drilling assembly should not drill into; and issuing an alert based on the identification that the information associated with the first potential pathway violates the drilling rule associated with the zone where the drilling assembly should not drill into.

Aspect 3: The method of any of Aspects 1 or 2, further comprising pausing drilling of the wellbore based on the alert.

Aspect 4: The method of any of Aspects 1 through 3, further comprising receiving a command associated with the alert; and re-starting the drilling of the wellbore based on the received command.

Aspect 5: The method of any of Aspects 1 through 4, further comprising initiating operation of a drilling assembly to drill along the first potential pathway; updating the visualization as the drilling assembly drills along the first potential pathway; and displaying the updated visualization.

Aspect 6: The method of any of Aspects 1 through 5, further comprising accessing a drilling rule; and identifying an area associated with the drilling rule; wherein the area associated with the drilling rule is identified in the visualization, or by a computer controlling a drilling assembly when the wellbore is drilled.

Aspect 7: The method of any of Aspects 1 through 6, further comprising receiving additional data that identifies a second potential pathway; generating at least one of an updated visualization or the second visualization that shows a second potential pathway; and displaying the updated visualization of the second visualization that shows the second potential pathway.

Aspect 8: The method of any of Aspects 1 through 7, wherein the visualization is a three-dimensional (3D) visualization.

Aspect 9: A non-transitory computer-readable storage medium having embodied therein a program executable by a processor for implementing a method comprising: accessing well plan data; accessing existing wellbore data; identifying boundary zone data to associate with an overlaid dataset that includes the well plan data, the existing wellbore data, and the boundary zone data; receiving data that identifies a first potential pathway of a wellbore; and generating a visualization from the overlaid dataset based on receiving the data that identifies the first potential pathway, wherein the visualization is displayed on a display such that a user can view the first potential pathway of the wellbore.

Aspect 10: The non-transitory computer-readable storage medium of Aspect 9, the program further executable to identify that information associated with the first potential pathway of the wellbore violates a drilling rule associated with a zone where a drilling assembly should not drill into; and issue an alert based on the identification that the information associated with the first potential pathway violates the drilling rule associated with the zone where the drilling assembly should not drill into.

Aspect 11: The non-transitory computer-readable storage medium of any of Aspects 9 or 10, the program further executable to pause drilling of the wellbore based on the alert.

Aspect 12: The non-transitory computer-readable storage medium of any of Aspects 9 through 11, the program further executable to receive a command associated with the alert; and re-start the drilling of the wellbore based on the received user input.

Aspect 13: The non-transitory computer-readable storage medium of any of Aspects 9 through 12, the program further executable to initiate operation of a drilling assembly to drill along the first potential pathway; update the visualization as the drilling assembly drills along the first potential pathway; and display the updated visualization.

Aspect 14: The non-transitory computer-readable storage medium of any of Aspects 1 through 13, the program further executable to access a drilling rule; and identify an area associated with the drilling rule; wherein the area associated with the drilling rule is identified in the visualization, or by a computer controlling a drilling apparatus when the wellbore is drilled.

Aspect 15: The non-transitory computer-readable storage medium of any of Aspects 9 through 14, the program further executable to receive additional data that identifies a second potential pathway; generate at least one of an updated visualization or a second visualization that shows the second potential pathway; and display the updated visualization of the second visualization that shows the second potential pathway.

Aspect 16: The non-transitory computer-readable storage medium of any of Aspects 9 through 15, wherein the visualization provides a three-dimensional (3D) image to a user.

Aspect 17: An apparatus comprising a memory; and a processor that executes instructions out of the memory to: access well plan data; access existing wellbore data; identify boundary zone data to associate with an overlaid dataset that includes the well plan data, the existing wellbore data, and the boundary zone data. The processor may also execute instructions out of the memory to evaluate data that identifies a first potential pathway of a wellbore; and a display upon which a visualization generated from the overlaid dataset is displayed based on the data that identifies the first potential pathway such that a user can view the first potential pathway of the wellbore.

Aspect 18: The apparatus of Aspect 17, wherein the processor executes the instructions to identify that information associated with the first potential pathway of the wellbore violates a drilling rule associated with a zone where a drilling assembly should not drill into; and issue an alert based on the identification that the information associated with the first potential pathway violates the drilling rule associated with the zone where the drilling assembly should not drill into.

Aspect 19: The apparatus of any of Aspects 17 or 18, further comprising a control output that passed data that pauses drilling of the wellbore based on the alert.

Aspect 20: The apparatus of any of Aspects 17 through 19, wherein the display displays three-dimensional (3D) images.

Other examples of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Some examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of a set" and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

What is claimed is:

1. A method comprising: accessing well plan data that identifies a starting point and an ending point of a wellbore; accessing existing wellbore data; identifying boundary zone data to associate with an overlaid dataset that includes the well plan data, the existing wellbore data, and the boundary zone data; selecting a drilling approach angle using a drilling rule that identifies at least one of a minimum or maximum approach angle; identifying a plurality of areas of a field of wellbores as zones that should not be drilled by a drilling assembly; classifying the plurality of areas of the field of wellbores as the zones that should not be drilled by the drilling assembly; receiving data that identifies a first potential pathway of the wellbore that includes the starting point and the ending point of the wellbore and that avoids the plurality of areas classified as the zones that should not be drilled; initiating operation of the drilling assembly to drill along the first potential pathway of the wellbore; and in response to selecting the drilling approach angle, steering the drilling assembly in real time to avoid the plurality of areas classified as the zones that should not be drilled and avoids colliding with the path of another wellbore.

2. The method of claim 1, further comprising: identifying that the drilling assembly will likely approach within a threshold safety margin distance of a second wellbore; and issuing an alert based on the identification that the drilling assembly will likely approach within the threshold safety margin distance of the second wellbore.

3. The method of claim 2, further comprising:

automatically pausing drilling of the wellbore based on the alert, receiving a command associated with the alert; and re-starting the drilling of the wellbore based on the received command.

4. The method of claim 1, wherein the drilling approach angle is associated with a change in a formation property.

5. The method of claim 1, further comprising:

generating a visualization from the overlaid dataset based on receiving the data that identifies the first potential pathway of the wellbore, wherein the visualization is displayed on a display such that a user can view the first potential pathway of the wellbore;

updating the visualization as the drilling assembly drills along the first potential pathway; and displaying the updated visualization.

6. The method of claim 1, further comprising:

identifying first cross-sectional area to associate with a first density of rock along the first potential pathway; and identifying a second cross-sectional area to associate with a second density of rock along the first potential pathway, wherein:

the drilling assembly is controlled based on the first cross-sectional area being associated with the first density of rock and the second cross-sectional area being associated with the second density of rock, and the maximum or minimum approach angle is associated with a change in rock density from the first density of rock to the second density of rock.

7. The method of claim 1, further comprising:

generating a visualization from the overlaid dataset based on receiving the data that identifies the first potential pathway of the wellbore, wherein the visualization is displayed on a display such that a user can view the first potential pathway of the wellbore;

receiving additional data that identifies a second potential pathway;

generating at least one of an updated visualization or a second visualization that shows the second potential pathway; and displaying the updated visualization of the second visualization that shows the second potential pathway.

8. The method of claim 7, wherein the visualization is a three-dimensional (3D) visualization.

9. A non-transitory computer-readable storage medium having embodied therein a program executable by a processor for implementing a method comprising: accessing well plan data that identifies a starting point and an ending point of a wellbore; accessing existing wellbore data; identifying boundary zone data to associate with an overlaid dataset that includes the well plan data, the existing wellbore data, and the boundary zone data; identifying a plurality of areas of a field of wellbores as zones that should not be drilled by a drilling assembly; selecting a drilling approach angle using a drilling rule that identifies at least one of a minimum or maximum approach angle; classifying the plurality of areas of the field of wellbores as the zones that should not be drilled by the drilling assembly; receiving data that identifies a first potential pathway of the wellbore that includes the starting and the ending point of the wellbore and that avoids the plurality of areas classified as the zones that should not be drilled; initiating operation of the drilling assembly to drill along the first potential pathway of the wellbore; and in response to selecting the drilling approach angle, steering the drilling assembly in real time to avoid the plurality of areas classified as the zones that should not be drilled and avoids colliding with the path of another wellbore.

10. The non-transitory computer-readable storage medium of claim 9, the program further executable to: identify that the drilling assembly will likely approach within a threshold safety margin distance of a second wellbore; and issue an alert based on the identification that the drilling assembly will likely approach within the threshold safety margin distance of the second wellbore.

11. The non-transitory computer-readable storage medium of claim 10, the program further executable to:

automatically pause drilling of the wellbore based on the alert, receive a command associated with the alert; and re-start the drilling of the wellbore based on the received command.

12. The non-transitory computer-readable storage medium of claim 11, wherein the drilling approach angle is associated with a change in a formation property.

13. The non-transitory computer-readable storage medium of claim 9, the program further executable to:

generate a visualization from the overlaid dataset based on receiving the data that identifies the first potential pathway of the wellbore, wherein the visualization is displayed on a display such that a user can view the first potential pathway of the wellbore;

update the visualization as the drilling assembly drills along the first potential pathway; and display the updated visualization.

14. The non-transitory computer-readable storage medium of claim 9, the program further executable to:

identify first cross-sectional area to associate with a first density of rock along the first potential pathway; and identify a second cross-sectional area to associate with a second density of rock along the first potential pathway, wherein:

the drilling assembly is controlled based on the first cross-sectional area being associated with the first density of rock and the second cross-sectional area being associated with the second density of rock, and the maximum or minimum approach angle is associated with a change in rock density from the first density of rock to the second density of rock.

15. The non-transitory computer-readable storage medium of claim 9, the program further executable to:

generate a visualization from the overlaid dataset based on receiving the data that identifies the first potential pathway of the wellbore, wherein the visualization is displayed on a display such that a user can view the first potential pathway of the wellbore;

receive additional data that identifies a second potential pathway;

generate at least one of an updated visualization or a second visualization that shows the second potential pathway; and display the updated visualization of the second visualization that shows the second potential pathway.

16. The non-transitory computer-readable storage medium of claim 15, wherein the visualization provides a three-dimensional (3D) image to a user.

17. An apparatus comprising: a memory; a processor that executes instructions out of the memory to: access well plan data that identifies a starting point and an ending point of a wellbore; access existing wellbore data; identify boundary zone data to associate with an overlaid dataset that includes the well plan data, the existing wellbore data, and the boundary zone data; selecting a drilling approach angle using a drilling rule that identifies at least one of a minimum or maximum approach angle; identify a plurality of areas of a field of wellbores as zones that should not be drilled by a drilling assembly; classify the plurality of areas of the field of wellbores as the zones that should not be drilled; evaluate data that identifies a first potential pathway of the wellbore; initiate operation of the drilling assembly to drill along the first potential pathway of the wellbore; and in response to selecting the drilling approach angle, steering the drilling assembly in real time to avoid the plurality of areas classified as the zones that should not be drilled and avoids colliding with the path of another wellbore; and a display upon which a visualization generated from the overlaid dataset is displayed based on the data that identifies the first potential pathway of the wellbore such that a user can view the first potential pathway of the wellbore.

18. The apparatus of claim 17, wherein the processor executes the instructions to:

identify that the drilling assembly will likely approach within a threshold safety margin distance of a second wellbore; and issue an alert based on the identification that the drilling assembly will likely approach within the threshold safety margin distance of the second wellbore.

19. The apparatus of claim 18, further comprising:

a control output that passes data that pauses drilling of the wellbore based on the alert.

20. The apparatus of claim 17, wherein the display displays three-dimensional (3D) images.

* * * * *